United States Patent [19]

Zampino et al.

[11] 4,094,547

[45] June 13, 1978

[54] COMBINATION BUMPER TRAY APPLIANCE

[76] Inventors: Arthur T. Zampino; Dolores V. Zampino, both of 120 Beach 19 St., Far Rockaway, N.Y. 11691

[21] Appl. No.: 765,922

[22] Filed: Feb. 7, 1977

[51] Int. Cl.[2] ..... A47D 15/00

[52] U.S. Cl. ..... 297/182; 297/135

[58] Field of Search ..... 297/182, 135, 136, 137, 297/138, 148, 153, 384, 390, 188; 46/32, 26, 29; 35/18 A

[56] References Cited

U.S. PATENT DOCUMENTS

| | | | |
|---|---|---|---|
| 284,671 | 9/1883 | Reed | 297/182 X |
| 1,050,205 | 1/1913 | Conley | 297/182 |
| 1,253,044 | 1/1918 | Kapelman | 297/390 |
| 1,309,343 | 7/1919 | Thomas | 297/182 |
| 1,429,867 | 9/1922 | Goldsmith | 297/250 |
| 2,540,685 | 2/1951 | Mayer | 297/182 |
| 2,700,413 | 1/1955 | Williams | 297/182 |
| 2,827,953 | 3/1958 | Jones | 297/182 |
| 2,938,574 | 5/1960 | Brown | 297/182 |
| 3,213,565 | 10/1965 | Grosz | 46/32 X |
| 3,245,716 | 4/1966 | Danner | 297/182 X |
| 3,506,302 | 4/1970 | House | 297/148 |
| 3,558,186 | 1/1971 | Shore et al. | 297/136 |
| 3,648,404 | 3/1972 | Ogsbury | 46/29 |
| 3,788,699 | 1/1974 | Starr | 297/153 |

*Primary Examiner*—James T. McCall
*Attorney, Agent, or Firm*—Edith T. Grill

[57] ABSTRACT

A combination bumper, feeding tray, toy holder and retriever appliance adapted to be used with a chair comprising a circular or oval tray provided with a solid U-shaped opening situated slightly off-center and of sufficient size to accomodate the body of a child, with the straight edge of the U-shaped opening fitting over the backrest of a chair; a horizontal radially extending support means surrounding said U-shaped opening; said support means being provided with a suitable number of apertures for positioning and supporting toys and feeding plates having a configuration adapted to be received and supported by said apertures; and a circumferentially continuous upwardly inclined member contiguous with said horizontal support means.

8 Claims, 5 Drawing Figures

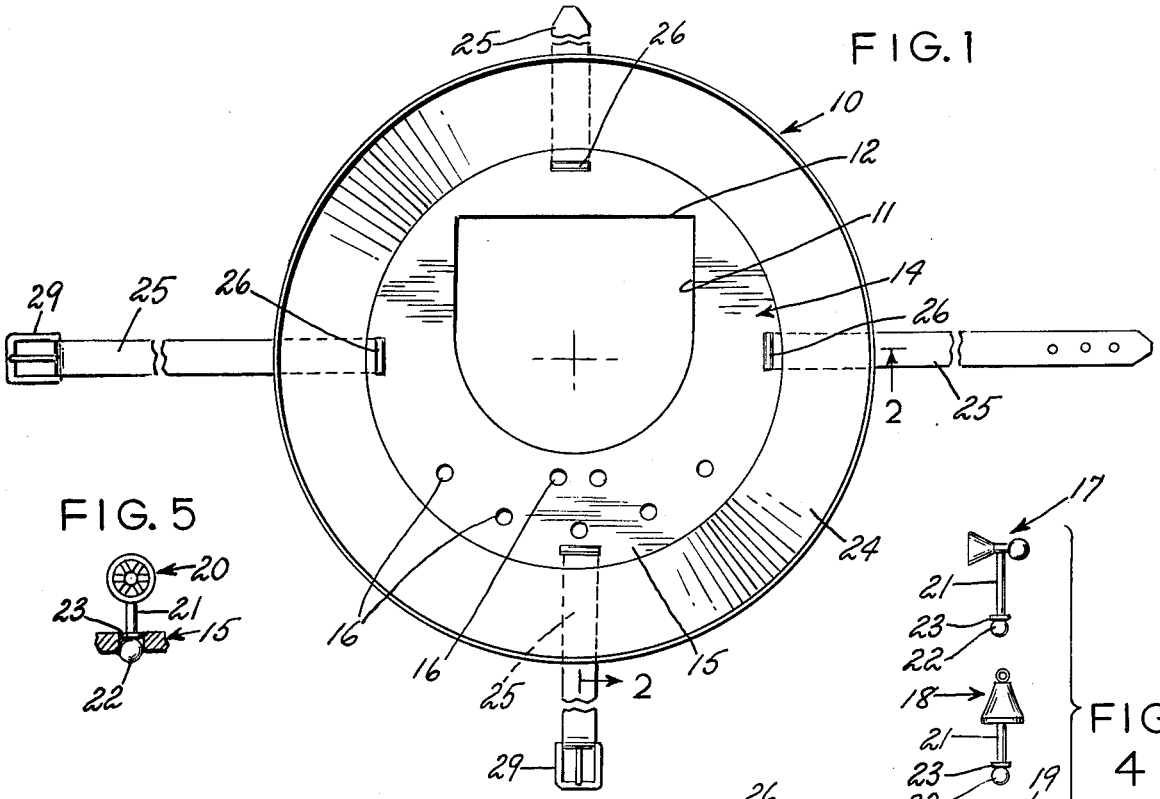
FIG. 1
FIG. 5
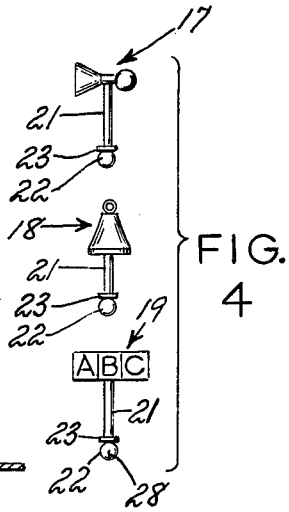
FIG. 4
FIG. 2
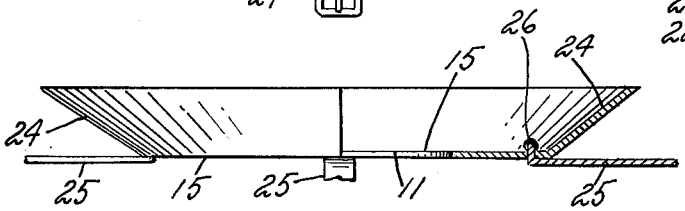
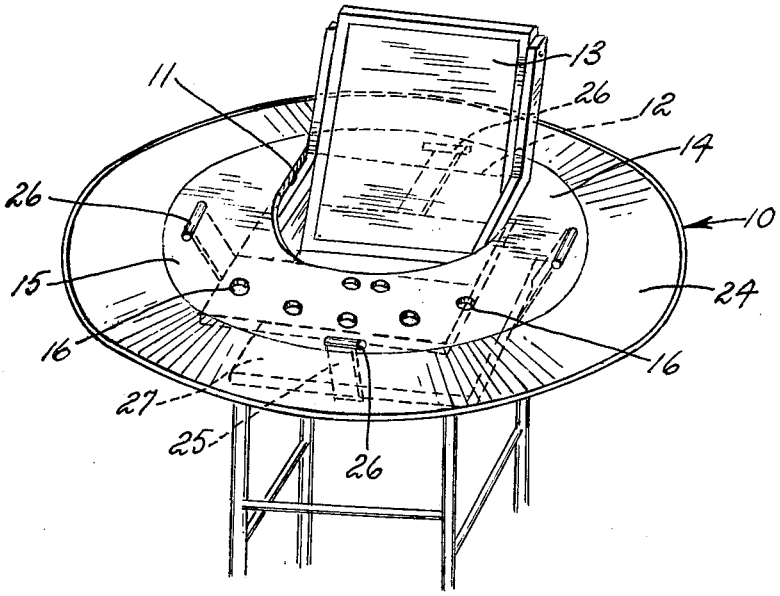
FIG. 3

COMBINATION BUMPER TRAY APPLIANCE

This invention relates to a new appliance which is a combination bumper guard, feeding tray, toy holder and retriever adapted to be mounted on and supported by the arms of a chair or the tray of a high chair, walker or similar baby furniture.

The prior art discloses sundry devices designed to provide toy holders and to guard an infant or small child while seated in a high chair. One such device is disclosed in U.S. Pat. No. 1,056,337 to Hurlbut, wherein playthings are secured to individual flexible connections which can be unwound and rewound on corresponding drums situated and secured to the underside of a playing board adapted to be secured to a child's high chair. Another toy holder and guard means is disclosed in U.S. Pat. No. 2,628,666 to Hall, wherein a vertical rod is attached to the outer rim of a high chair tray, the lower end of said vertical rod fitting into an opening in the high chair seat and the upper end of said rod supporting a horizontal bar from which are suspended an assortment of toys on individual strings. In addition, U.S. Pat. No. 3,213,565 to Grosz discloses a bathtub toy designed to be supported by the walls of a bathtub comprising a playing board containing apertures for receiving open ended containers, funnels and the like. Thus, it is apparant that various attempts have been made to amuse a young child while safely seated in a high chair or bathtub without necessitating the constant retrieval from the floor of dropped toys.

However, none of these attachments have the advantages of the appliance of present invention which has the quadruple function of a bumper guard, feeding tray, toy holder and a retriever, and can be removably secured to baby furniture such as a high chair, baby walker, baby tender, car seat, swing; or can be substituted for the trays presently on said baby furniture. Present novel tray is a unitary device which can be inexpensively produced from any suitable plastic material such as polyethylene or other resilient material or can be made out of wood or lightweight metal such as aluminium.

Present novel quadruple-duty appliance, in general, is in the form of a circular or oval tray provided with a solid U-shaped opening situated slightly off-center and of sufficient size to accomodate the body of a child with the straight edge of the U-shaped opening fitting over the backrest of a chair; a horizontal radial surface surrounding the opening to provide a support means for toys, feeding dishes and the like, the front portion thereof being provided with a suitable number of apertures for removably receiving a variety of toys and feeding plates, said apertures corresponding in size with and adapted to receive the rounded ball end of a snap-in toy or plate; and a circumferentially continuous member pitched or sloped upwardly at an acute angle, preferably at about a 40°-50° angle, contiguous with said radial horizontal support means. The horizontal support means functions as a playboard and eating tray, with the toys being situated within the grasp of the child. The outer pitched or inclined area functions as a retrieval zone for objects tossed or dropped by the child. It will slide down the incline back onto the horizontal surface. The tray is additionally provided with attachment means such as straps which fit under the seat of the chair and are secured at the outer edge of the horizontal support means of the tray to provide additional safety to the child by preventing the child from slipping through the seat opening. The tray is additionally provided with snap-in toys made out of suitable plastic and comprises a toy such as a bell, rattle, horn, doll, block, spinning wheel, clown, and the like mounted on a stem which terminates in a rounded ball end adapted to be inserted into the apertures on the horizontal support means of the tray. The feeding plate may be similarly provided with at least one ball on its undersurface to enable it to be inserted into said apertures. These toys are called snap-in toys because of the ball end of the toy which can readily be snapped into and out of the apertures by an adult, but not by a small child. The total tray functions as a bumper guard since it extends beyond the confines of the chair-like furniture and protects baby's limbs from collision with dangerous corners, tables, radiators, stoves and the like. It also provides stability against turning over because of its design.

More specifically instant invention provides an appliance adapted to be removably secured to baby chair-like furniture or to substitute for the tray of said baby furniture which comprises a round or oval tray provided with a solid U-shaped opening situated slightly off-center and of sufficient size to accomodate the body of a child with the straight edge of said U-shaped opening fitting over the backrest of a chair, a horizontal radially extending support means surrounding said U-shaped opening to provide a combination playboard means and feeding tray, said playboard means being provided with apertures for positioning and supporting toys and feeding plates having a configuration adapted to be received and supported by said apertures; and a circumferentially continuous upwardly inclined member contiguous with said horizontal support means. The toys and the feeding plates are provided with a rounded ball end which is adapted to be removably received by said apertures. The appliance of present invention may be additionally provided with attachment means secured at the outer edges of the horizontal support means and across the U-shaped opening to secure the appliance to the chair, said attachment means being flexible and detachably secured to the horizontal support means. Said flexible attachment means may be separable or permanently affixed to the horizontal support means.

Therefore, it is a principal object of this invention to provide a unitary combination bumper tray having the quadruple functions of a bumper guard, feeding tray, toy holder and object retriever, capable of either being mounted on baby chair-like furniture or being substituted for the tray portion of baby furniture.

Another object of this invention is to provide a support for snap-in toys which cannot be removed from said support by the child, but is readily removable therefrom by an adult.

Another object of this invention is to provide a safe and convenient means for keeping toys and other objects within the reach of a child and prevent them from falling to the floor.

Still another object of this invention is to provide a variety of interchangeable toys for the continued amusement of the child.

Still another object of this invention is to provide a guard to protect baby's limbs from injury due to contact with sharp corners, radiators, hot stoves and the like.

In accordance with the above objects and such other objects and features which will become apparant from the following specification, the invention will be understood from the accompanying drawings, wherein like characters designate like parts and wherein:

FIG. 1 is a top plan view of the combination bumper tray of instant invention;

FIG. 2 is a side view partly in cross section, with cross section taken along lines 2—2 of FIG. 1;

FIG. 3 is a perspective view of instant bumper tray shown mounted on a high chair;

FIG. 4 is a front view of snap-on toys; and

FIG. 5 is a front sectional view of a snap-on toy positioned in the combination bumper tray of this invention.

Referring to the drawings in detail, the combination bumper tray of this invention comprises a circular or oval tray 10 provided with a U-shaped opening 11 situated slightly off center and of sufficient size to accomodate the body of a child, the straight edge 12 of opening 11 fitting around the backrest 13 of a chair. The opening is preferably about 13 inches wide and 10 inches deep but may be varied, the only limitation being to comfortably accomodate the body of an infant or child. The overall dimensions of the combination bumper tray may be varied and is preferably from about 36 to 42 inches in diameter depending on the size of the chair onto which it is to be mounted and/or attached. These dimensions are sufficiently large to afford protection to the limbs of a child from dangerous collisions and possible turnovers of the chair thereby functioning as a bumper guard. In addition, it provides stability to baby walkers and the like. If an oval tray is contemplated, the dimensions can be altered accordingly.

Opening 11 is surrounded by a horizontal radially extending support means 14 provided with a combination playboard means and feeding tray 15, which is provided with a plurality of apertures 16, for positioning and supporting snap-in toys 17, 18, 19 and 20, said toys having a configuration adapted to be received and supported by apertures 16 and positioned within the child's grasp. Apertures 16 are preferably round and sized, about ¾ inch in diameter, to accomodate the ball end 22 of the toys. Apertures 16 are preferably positioned toward the outer periphery of playboard 15 so as to leave the inner area free to function as a feeding tray, this area being additionally provided with at least one aperture 16 designated to engage at least one ball 22 situated on the undersurface of a feeding plate, either with or without an intervening stem 21.

Snap-in toys 17, 18, 19 and 20 are mounted on a stem 21 which may be rigid, semi-rigid or flexible, and which terminates in a rounded or oval ball 22 adapted to frictionally fit into sized apertures 16. These toys in its entirety are preferably made out of resilient plastic and the ball end 22 is easily snapped into and out of apertures 16 by adults, similarly to the action of poppits. Ball 22 may optionally be provided with a slit 28, centrally located, to facilitate insertion into and removal from apertures 16. After the ball 22 is inserted, it spreads apart due to slit 28 and acts as a wedge within apertures 16 to more firmly engage said toy or plate (not shown) to playboard 15. When a pulling action is exerted on the ball 22 to remove it from aperture 16, slit 28 permits ball 22 to contract for easy removal. Stopper 23 situated directly above the ball 22 holds the toy erect after it is inserted into apertures 16 and permits the child to grasp and play with the toy. In addition, stopper 23 prevents the removal of the toys from the tray by the child. In order to remove the toys from aperture 16, stopper 23 must first be removed prior to exerting a pulling action on ball 22. The resilience of ball 22 permits its extraction from sized apertures 16. Similarly, the application of a pushing pressure enables the insertion of ball 22 into apertures 16. This action can best be characterized as a snap-in and out action. Stopper 23 is suitably shaped, preferably round, to fit into aperture 16 and fits either flush with the upper surface of playboard and feeding tray 15, or may protrude above the upper surface thereof.

Accordingly, this horizontal support means functions as a playboard and toy holder. With the toys removed or in place, said support means 15 also functions as a feeding tray. Although the dimensions of this combined eating and play area 15 is variable, it is preferred to be about 7 to 8 inches deep so that it can afford a suitable area for eating and/or playing and is adapted to fit on conventional high chairs or similar baby furniture as shown in FIG. 3. The rear portion of this radial horizontal support 14 is not as deep as the playboard 15, because of the off-center opening 11, and is preferably only about 4 inches deep.

Tray 10 additionally comprises a circumferentially continuous upwardly sloped or inclined member 24, preferably at an acute angle of about 40°–50°, and contiguous with said horizontal support means 14; said upwardly inclined member being of equal depth in its entirety, preferably about 6 to 8 inches deep. This inclined member 24 functions as a retriever for any articles dropped or thrown by the baby, said articles simply sliding back down the incline to the horizontal playboard area 15 where the baby can reach them and again pick them up. The advantages of this feature is self-evident to baby sitters and parents.

Tray 10 is additionally provided with at least one pair and preferably two pairs of openings 26 positioned at the outer edge of horizontal support means 14, and across U-shaped opening 11. One such pair of openings 26 is situated in the front and rear portions of the horizontal support 14, and another pair is positioned on opposite sides of horizontal support 14. Flexible means 25 such as straps are inserted through openings 26 and go under the seat 27 of a chair from front to back and/or side to side and are locked in place by any suitable means such as buckles 29, hooks and eyes, snaps or the like. Thus, it is apparant that flexible means 25 not only secures the bumper tray 10 to the high chair, but also functions as a barrier or obstruction to restrain the seated child from falling through the space between the tray and the seat of the chair. In lieu of separable attachment means as aforedefined, said flexible attachment means 25 may be permanently secured at at one end thereof to the horizontal support means 14 by permanently affixed securing means 26 such as hooks, screws, rivets, snaps, bolts and the like. The unattached end of said flexible attachment means 25 is provided with a loop, hook, snap or the like which is adapted to detachably engage a corresponding securing means 26 such as a screw, eye, snap, or the like permanently affixed to the horizontal support 14, directly across U-shaped opening 11.

It will be readily appreciated that with this bumper tray attached to a high chair, walker or other chair-tray combination, amusing a small child is simplified and the picking up of toys thrown to the ground is substantially eliminated. The inclined surface of instant novel tray is effective in retrieving thrown or dropped objects, thereby providing the child with a continuous source of objects for holding and playing. In addition the snap-in toys which remain affixed to the horizontal surface of the tray provides the child with an assortment of toys which he can continuously handle and play with, without losing them. In addition, if the novel combination tray of this invention is mounted on a walker, the child's limbs are safely within the confines of the tray, thereby preventing danger to himself when he colides with corners of furniture, hot stoves, radiators, and the like, as he learns to walk.

The bumper tray of present invention is also useful and can be attached to chairs for invalids such as wheelchairs and the like to provide a combined playboard and eating tray. Consequently, the bumper tray of present invention can be supported by the arms of any chair and be attached to any chair to provide a combined playboard and eating tray.

Present bumper tray is semi-rigid and can be inexpensively and simply manufactured by molding as a unitary unit from a suitable semi-flexible and resilient plastic material. Instant unitary tray is designed to be detachably attached to a chair, using the arms of a chair as the support therefor or it can rest on the eating tray of a high chair. Accordingly, instant novel bumper tray can be substituted for the eating tray of a high chair or the like, or it can merely be superimposed thereon as a temporary measure.

Although this invention has been described with reference to specific embodiments, it will be apparant to one skilled in the art that various modifications and equivalents may be made thereto which fall within the scope herein.

We claim:

1. An appliance adapted to be used with a chair as a combination bumper tray and toy holder which comprises a semi-rigid, unitary circular or oval tray provided with an off-center solid U-shaped opening of sufficient size to accommodate the body of a child with the straight edge of the U-shaped opening fitting over the backrest of a chair, said tray comprising a horizontal radial surface of lesser depth in the rear portion than the front portion thereof, integral with an upwardly and outwardly inclined circumferentially continuous surface of equal depth in its entirety, the front portion of said horizontal surface being provided with round sized apertures for removably receiving toys and feeding plates mounted on round or oval equally sized ball ends adapted to frictionally fit into said sized apertures.

2. An appliance in accordance with claim 1, additionally provided with flexible attachment means secured at the outer edge of the horizontal surface of said tray which fits under the seat of the chair.

3. An appliance in accordance with claim 1, wherein said upwardly and outwardly inclined surface functions as a retrieval zone for objects thrown by the child which slide down said inclined surface onto said horizontal surface.

4. An appliance in accordance with claim 1, wherein the toys are provided with a stem which terminates in a ball.

5. An appliance in accordance with claim 4, wherein the toys are additionally provided with a stopper for insertion into the apertures to hold the toys erect.

6. An appliance in accordance with claim 2, wherein the flexible attachment means is detachably secured to the horizontal support means.

7. An appliance in accordance with claim 2, wherein the flexible attachment means is permanently affixed to the horizontal support means.

8. An appliance in accordance with claim 2, wherein the attachment means fits under the seat of the chair from front to back, and/or side to side.

* * * * *